US007401773B2

(12) United States Patent
Chen

(10) Patent No.: US 7,401,773 B2
(45) Date of Patent: Jul. 22, 2008

(54) PAPER-FEEDING MECHANISM WITH SWING ARM AND GEAR TRAIN

(75) Inventor: Chien-Chih Chen, Taipei Hsien (TW)

(73) Assignee: Qisda Corporation, Shang-Ting Tsun, Gueishan Hsiang, Taoyuan (TW)

( * ) Notice: Subject to any disclaimer, the term of this patent is extended or adjusted under 35 U.S.C. 154(b) by 44 days.

(21) Appl. No.: 11/382,716

(22) Filed: May 11, 2006

(65) Prior Publication Data

US 2006/0257194 A1 Nov. 16, 2006

(30) Foreign Application Priority Data

May 12, 2005 (TW) ..... 94115412 A

(51) Int. Cl.
*B65H 3/06* (2006.01)

(52) U.S. Cl. ..... 271/117; 271/109

(58) Field of Classification Search ..... 271/109, 271/117

See application file for complete search history.

(56) References Cited

U.S. PATENT DOCUMENTS 4,577,849 A * 3/1986 Watanabe ..... 271/9.02
4,978,112 A * 12/1990 Yokoi ..... 271/9.02
5,954,326 A * 9/1999 Gaarder et al. ..... 271/9.02
6,896,253 B2 * 5/2005 Hanabusa ..... 271/117
2002/0190457 A1 * 12/2002 Gaarder ..... 271/109
2003/0002083 A1 * 1/2003 Jang et al. ..... 358/400
2003/0075856 A1 * 4/2003 Park ..... 271/117
2003/0193126 A1 10/2003 Hoberock
2004/0012139 A1 * 1/2004 Asada et al. ..... 271/113
2004/0195756 A1 * 10/2004 Su ..... 271/109
2005/0140082 A1 * 6/2005 Jung-Yun ..... 271/121
2005/0194733 A1 * 9/2005 Asada ..... 271/117
2007/0126170 A1 * 6/2007 Silverbrook et al. ..... 271/117

FOREIGN PATENT DOCUMENTS

CN 1439529 A 9/2003
CN 2609880 Y 4/2004
CN 2625152 Y 7/2004

* cited by examiner

*Primary Examiner*—Patrick Mackey
*Assistant Examiner*—Gerald W McClain
(74) *Attorney, Agent, or Firm*—Winston Hsu

(57) ABSTRACT

A paper-feeding mechanism includes a paper tray for positioning print media, a pickup roller installed in front of the paper tray for pressing print media so as to pick up print media, a pickup arm fixed to a first shaft at one end and connected to the pickup roller at another end for driving the pickup roller to rotate around the first shaft, a first gear installed inside the pickup arm and connected to a first end of the pickup roller, a swing arm fixed to a second shaft at one end and connected to a second gear for gearing the first gear at another end, a third gear fixed to the second shaft and engaged with the second gear for driving the swing arm and the second gear to rotate, and a driving device for driving the third gear.

7 Claims, 8 Drawing Sheets

PAPER-FEEDING MECHANISM WITH SWING ARM AND GEAR TRAIN

CROSS-REFERENCE TO RELATED APPLICATIONS

This application claims the benefit of the filing date of Taiwan Patent Application No. 094115412, filed May 12, 2005.

BACKGROUND OF THE INVENTION

1. Field of the Invention

The present invention relates to a paper-feeding mechanism, and more particularly, to a paper-feeding mechanism with fewer components to reduce cost and increase precision.

2. Description of the Prior Art

When printing to paper with a fax machine, a printer, or a multi-function product, a paper-feeding mechanism is utilized for feeding paper one sheet at a time into machines so as to proceed to faxes, printouts, copies, and so on. Please refer to FIG. 1, FIG. 1 is a diagram of a paper-feeding mechanism 10 of the prior art. The paper-feeding mechanism 10 includes a paper tray 12 for positioning print media 14, such as paper or transparencies. The paper-feeding mechanism 10 further includes a burster 16 installed below the paper tray 12, a shaft 18, a pickup arm 20, and a pickup roller 22. Both ends of the shaft 18 are fixed to two lateral sides of the paper tray 12. The shaft 18 is sheathed into one end of the pickup arm 20. The other end of the pickup arm is connected to the pickup roller 22. The pickup arm 20 rotates around the shaft 18 according to a change of thickness of the print media 14 on the paper tray 12 so that the pickup roller 22 can press the upper surface of the print media 14 steady. The pickup roller 22 can apply a normal force on the print media 14 so as to provide a friction force to move the print media 14.

Please refer to FIG. 2 and FIG. 3. FIG. 2 is a lateral view of the paper-feeding mechanism 10 in a full-of-paper condition in the prior art. FIG. 3 is a lateral view of the paper-feeding mechanism 10 in an empty-of-paper condition in the prior art. The pickup roller 22 can press the upper surface of the print media 14 steady and apply a normal force to the print media 14 so as to provide a friction force for causing the print media 14 to move downward. The burster 16 blocks a bottom of the print media 14 so as to buckle the print media 14 so that the top print medium can be separated from other print media and fed out individually. As shown in FIG. 2 and FIG. 3, the torque generated by the shaft 18 not only drives the pickup roller 22 connected to the pickup arm 20 to rotate, but also drives the pickup arm 20 to rotate so that the pickup roller 22 can press the upper surface of the print media 14 and apply enough normal force to the print media 14. However, the power generated by a motor is transmitted to the shaft 18 via a chain of gears on the right side of the shaft 18, as shown in FIG. 1, and then transmitted to the pickup roller 22 from the shaft 18 via a chain of gears inside the pickup arm 20. There are too many components used in the paper-feeding mechanism 10, such as the shaft 18, the outer casing of the pickup arm 20, many idle gears, and the corresponding gear shafts, so that the cost and operating noise increase and precision decreases.

SUMMARY OF THE INVENTION

It is therefore a primary objective of the claimed invention to provide a paper-feeding mechanism with fewer components to reduce cost and increase precision for solving the above-mentioned problem.

According to claimed invention, a paper-feeding mechanism includes a paper tray for positioning print media, a pickup roller installed in front of the paper tray for pressing print media so as to pick up print media, a pickup arm fixed to a first shaft at one end and connected to the pickup roller at another end for driving the pickup roller to rotate around the first shaft, a first gear installed inside the pickup arm and connected to a first end of the pickup roller, a swing arm fixed to a second shaft at one end and connected to a second gear for gearing the first gear at another end, a third gear fixed to the second shaft and engaged with the second gear for driving the swing arm and the second gear to rotate, and a driving device for driving the third gear.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
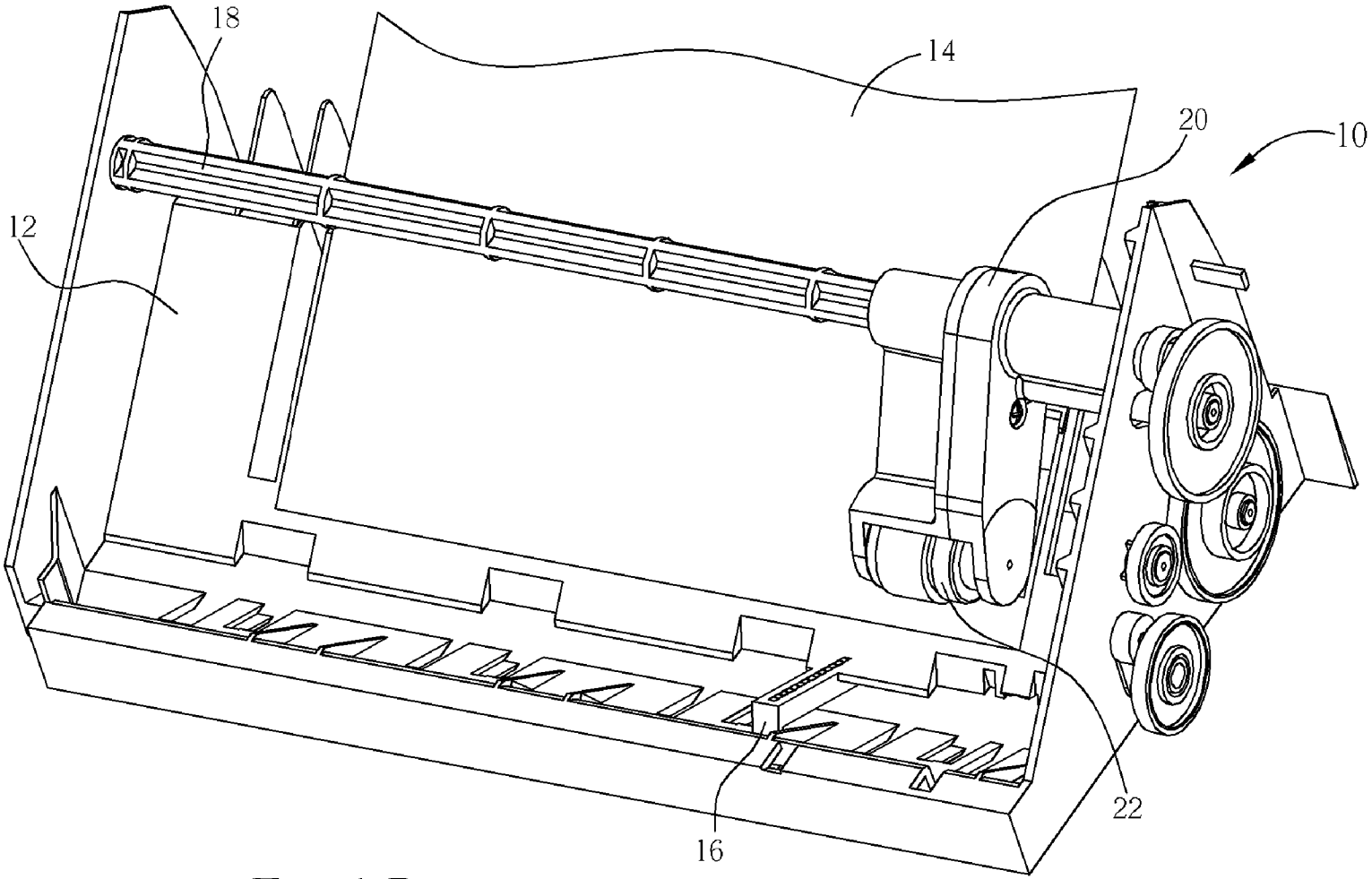
Fig. 1 Prior art
FIG. 1 is a diagram of a paper-feeding mechanism of the prior art.
Figure 2:
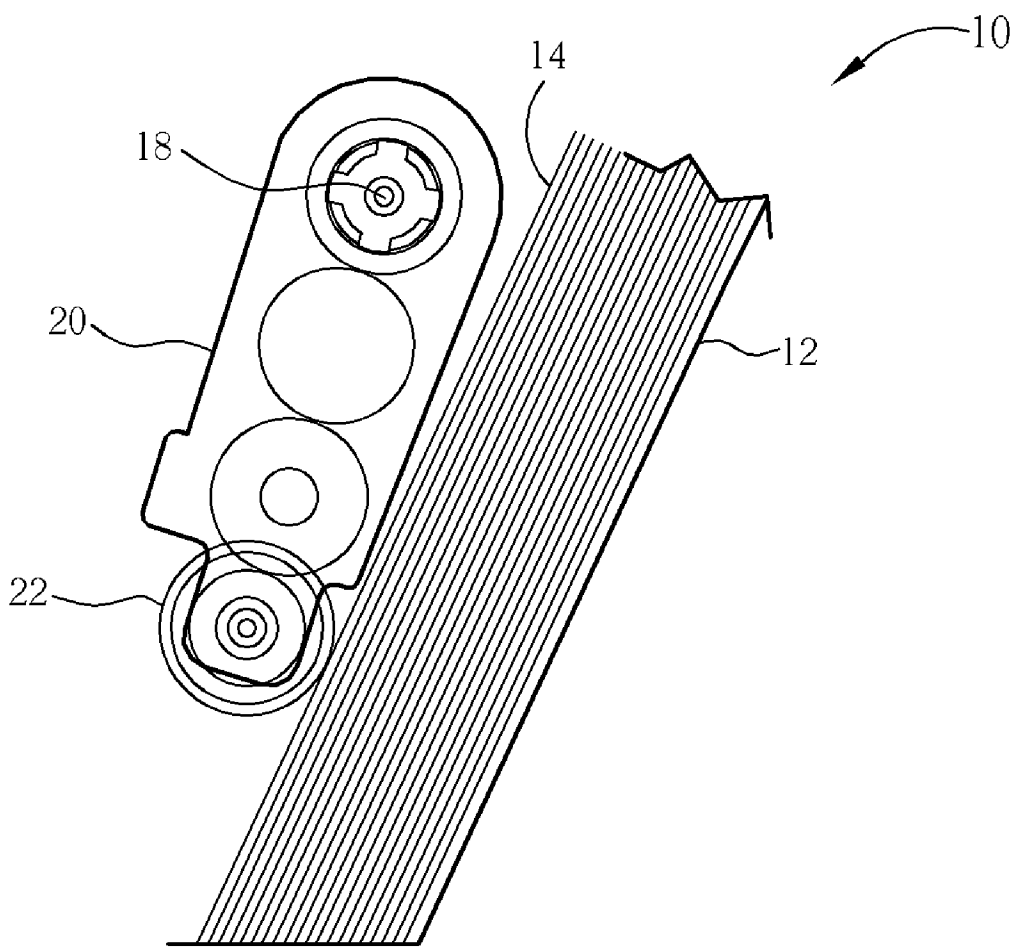
Fig. 2 Prior art
FIG. 2 is a lateral view of the paper-feeding mechanism of FIG. 1 in a full-of-paper condition in the prior art.
Figure 3:
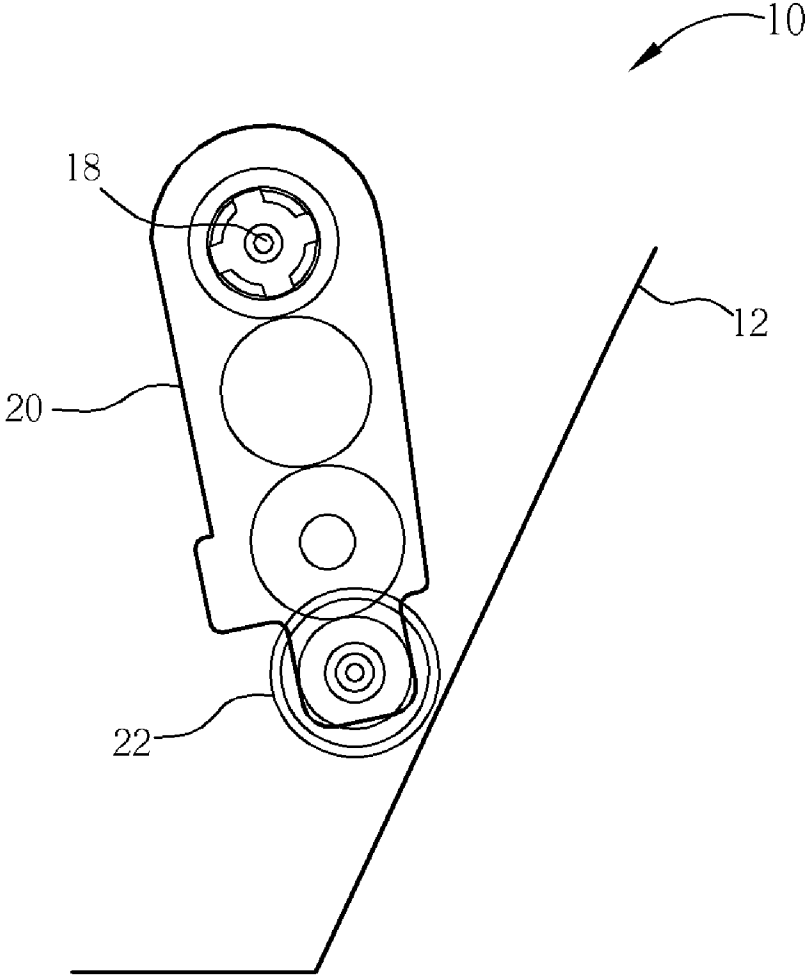
Fig. 3 Prior art
FIG. 3 is a lateral view of the paper-feeding mechanism of FIG. 1 in an empty-of-paper condition in the prior art.
Figure 4:
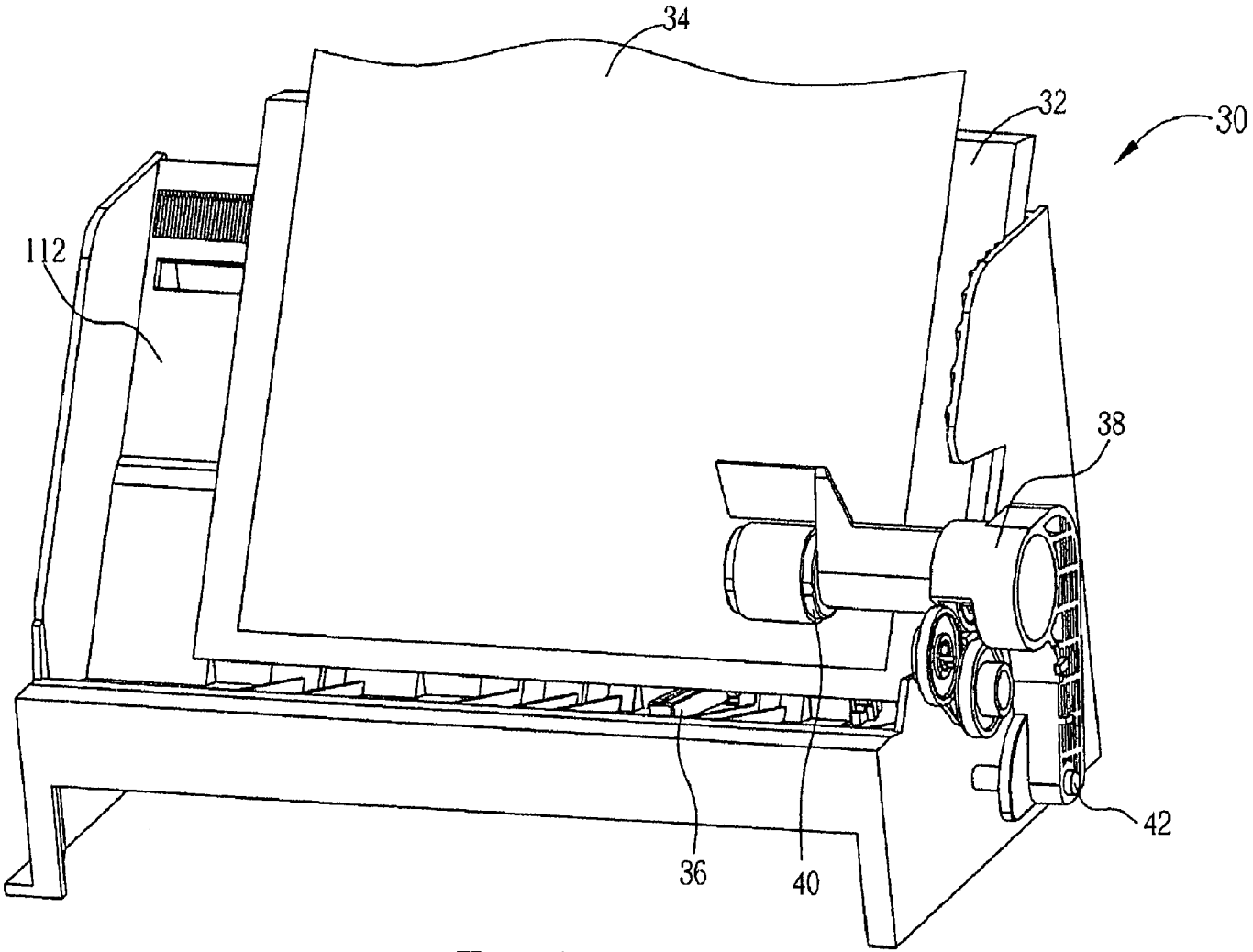
FIG. 4 is a diagram of a paper-feeding mechanism according to the present invention.

Please refer to FIG. 4. FIG. 4 is a diagram of a paper-feeding mechanism 30 according to the present invention. The paper-feeding mechanism 30 includes a paper tray 32 for positioning print media 34, such as paper or transparencies. The paper-feeding mechanism 30 further includes a burster 36 installed below the paper tray 32 for blocking a bottom of the print media 34 so as to buckle the print media 34 when the print media 34 moves downward, a pickup arm 38, and a pickup roller 40 installed in front of the paper tray 32 for pressing the print media 34 so as to pick up the print media 34 for subsequent movement downward. An end of the pickup arm 38 is connected to the pickup roller 40. The pickup arm 38 can rotate around a first shaft 42, and the rotating range of the pickup arm 38 around the first shaft 42 is greater than a thickness of fully loaded print media 34 on the paper tray 32 so that the pickup arm 38 can contact the print media 34 tightly and the pickup roller 40 can press the upper surface of the print media 34 steady. The pickup roller 40 can apply a normal force on the print media 34 so as to provide a friction force for driving the print media 34 to move downward. The burster 36 blocks a bottom of the print media 34 so as to buckle the print media 34 so that the top print medium can be separated from other print media and fed out individually.

Figure 5:
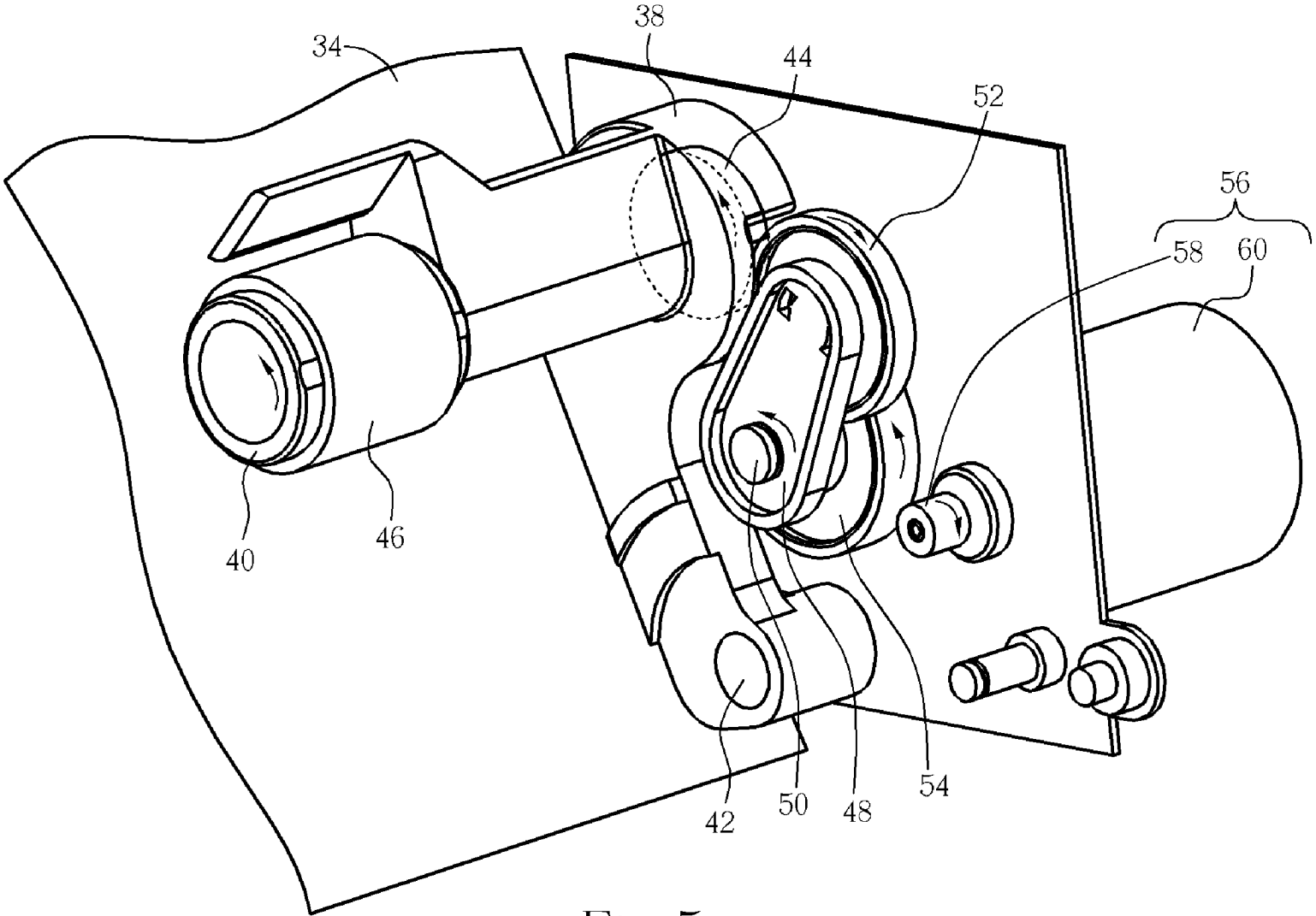
FIG. 5, FIG. 6, and FIG. 7 are diagrams of relative positions of internal components of the paper-feeding mechanism of FIG. 4 according to the present invention.
Figure 6:
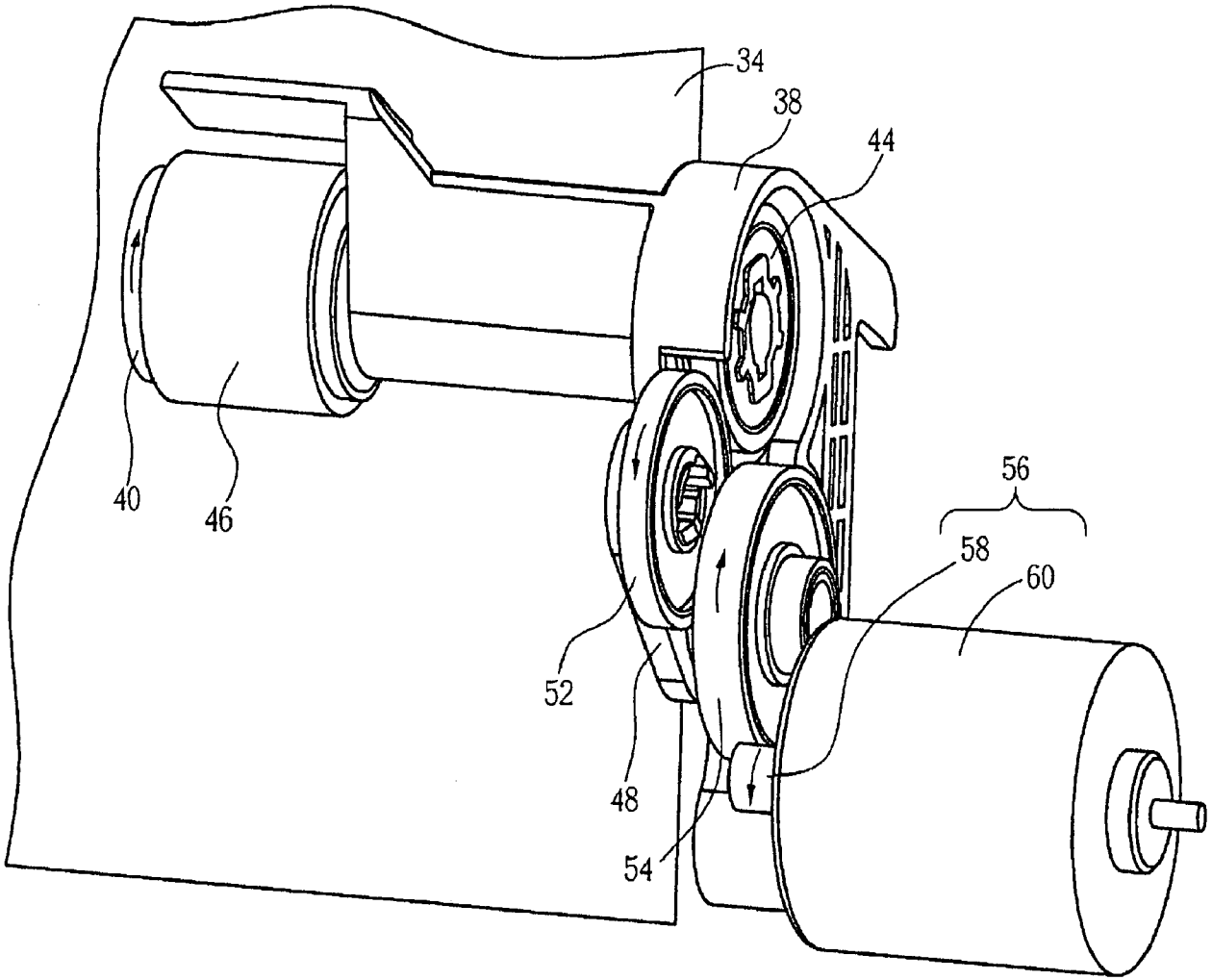
Figure 7:
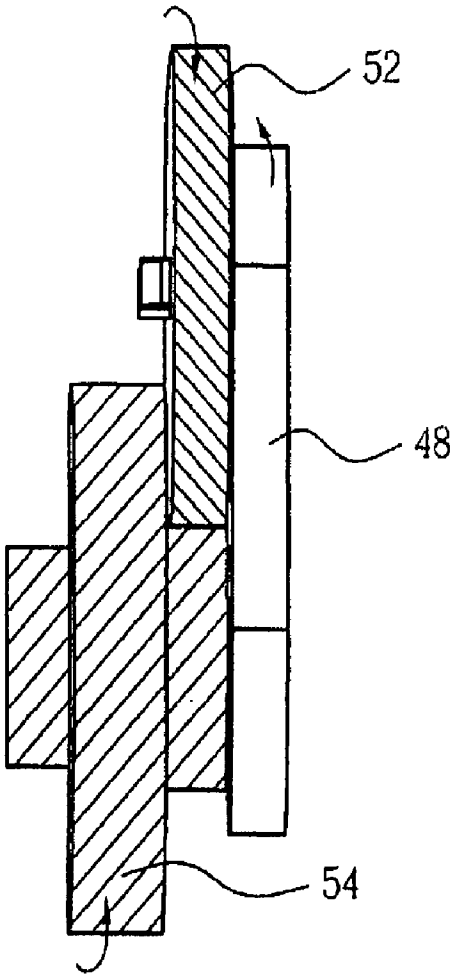
Figure 8:
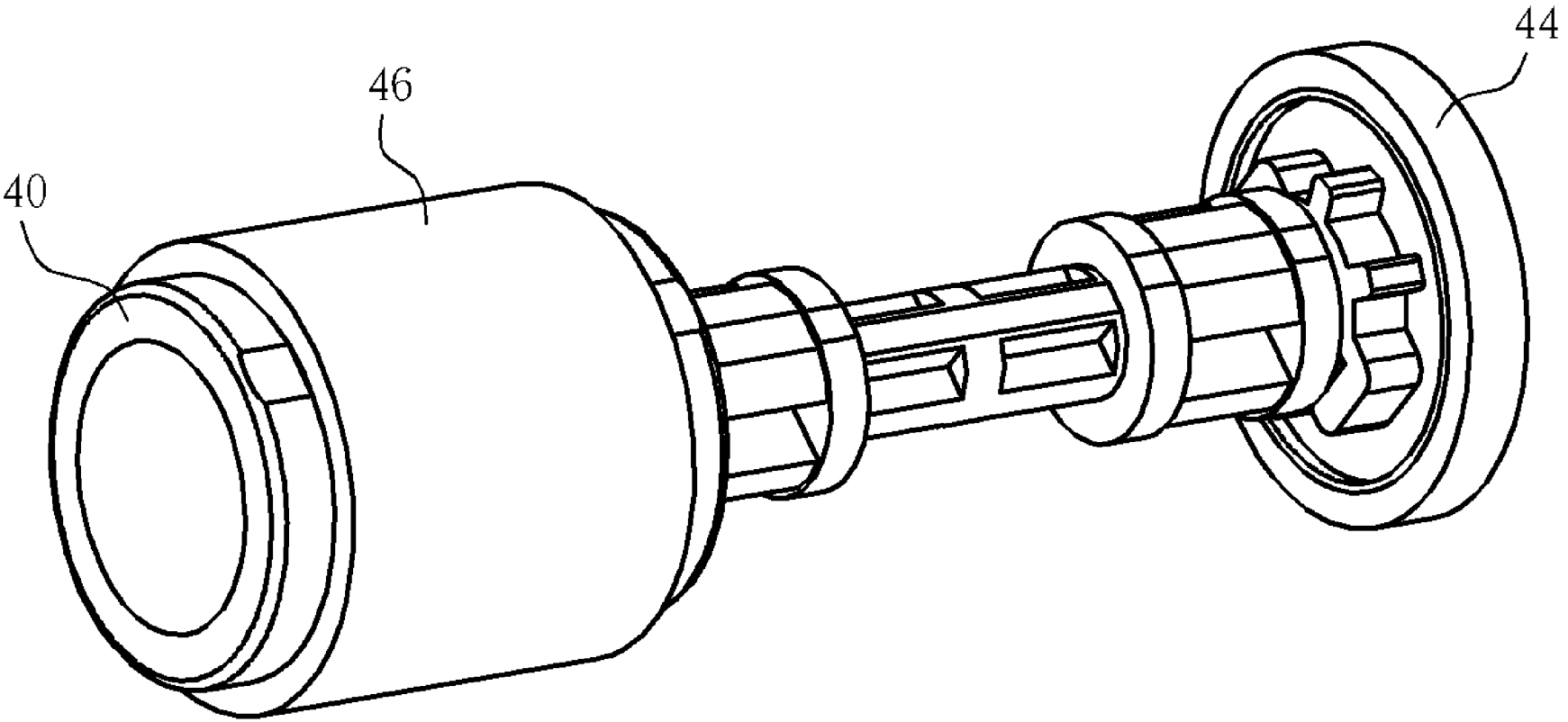
FIG. 8 is a diagram of a pickup roller according to the present invention.

Please refer to FIG. 5, FIG. 6, FIG. 7, and FIG. 8. FIG. 5, FIG. 6, and FIG. 7 are diagrams of relative positions of internal components of the paper-feeding mechanism 30 according to the present invention. FIG. 8 is a diagram of the pickup roller 40 according to the present invention. As shown in FIG. 5, one end of the pickup arm 38 is connected to the pickup roller 50, and the other end of the pickup arm 38 is fixed to the first shaft 42 for driving the pickup roller 40 to rotate around to the first shaft 42. As shown in FIG. 6 and FIG. 8, the paper-feeding mechanism 30 further includes a first gear 44 installed inside the pickup arm 38 and connected to one end of the pickup roller 40, and a sheath 46 installed around the other end of the pickup roller 40. The sheath 46 can be made of rubber material so as to provide enough friction force to move the print media 34. As shown in FIG. 5 and FIG. 6, the paper-feeding mechanism 30 further includes a swing arm 48 fixed to a second shaft 50 at one end and connected to a second gear 52 for engaging with the first gear 44 at the other end, a third gear 54 fixed to the second shaft 50 and engaged with the second gear 52 as shown in FIG. 7 for driving the swing arm 48 and the second gear 52 to rotate, a driving device 56 including a fourth gear 58 engaged with the third gear 54 for transmitting motive power to the third gear 54, and a motor 60 for driving the fourth gear 58 so as to drive the third gear 54 to rotate.

When the paper-feeding mechanism 30 starts to feed the print media 34, the motor 60 of the driving device 56 provides motive power to the fourth gear 58 so as to drive the fourth gear 58 to rotate clockwise, as an arrow shows in FIG. 5. At this time the third gear 54 engaged with the fourth gear 58 is driven to rotate counterclockwise, as another arrow shows in FIG. 5. Please refer to FIG. 5 and FIG. 7. Owing to the counterclockwise rotation of the third gear 54, the second gear 52 engaged with an small-diameter gear of the third gear 54 is driven to rotate clockwise, as another arrow shows in FIG. 5. Furthermore, the swing arm 48 fixed to the second shaft 50 (which is the same that the third gear 54 uses) is driven to rotate clockwise, as another arrow shows in FIG. 5. Hence, the second gear 52 not only rotates clockwise but also moves clockwise driven by the swing arm 48. The third gear 54 and the second shaft 50 can be connected by a tight fit and the swing arm 48 and the second shaft 50 can be connected by a tight fit so that the third gear 54 and the swing arm 48 can rotate around the second shaft 50 in the same direction. The swing arm 48 drives the second gear 52 to rotate around the second shaft 50 clockwise so that the second gear 52 can engage with the first gear 44 tightly and provide a force to the first gear 44. The force applied to the first gear 44 drives the pickup arm 38 to rotate around the first shaft 42 counterclockwise so that the pickup roller 40 can press the print media 34 tightly to apply more normal force onto the print media 34 so as to drive the print media 34 easily.

Please continue to refer to FIG. 5 and FIG. 6. Owing to the clockwise rotation of the second gear 52, the first gear 44 engaged with the second gear 52 is driven to rotate counterclockwise, as an arrow shows in FIG. 5. The first gear 44 is connected to one end of the pickup roller 40, so the pickup roller 40 is driven to rotate counterclockwise by the first gear 44, as another arrow shows in FIG. 5, so as to drive the print media 34 to exit the paper-feeding mechanism 30. On the contrary, when the paper-feeding mechanism 30 stops feeding the print media 34 and undergoes reloading of the print media 34 or removal of a paper jam, the motor 60 of the driving device 56 provides motive power to the fourth gear 58 so as to drive the fourth gear 58 to rotate counterclockwise. At this time the third gear 54, the second gear 52, and the swing arm 48 are driven in directions opposite the directions mentioned above. That is, the swing arm 48 rotates around the second shaft 50 clockwise so as to separate the second gear 52 from the first gear 44, and the first gear 44 is no longer driven. The pickup roller 40 is not driven and can not feed the print media 34. Furthermore the second gear 52 can not apply force to the first gear 44, so the end of the pickup arm 38 connected to the pickup roller 40 can be regarded as a free end. The print media 34 can be placed inside the paper tray 32 or pulled out from the paper tray 32 easily, instead of being under the normal constraint provided by the pickup roller 40. That is, the pickup arm 38 can be pushed by the print media 34 so as to rotate around the first shaft 42 clockwise. The present invention can overcome the disadvantage of overcoming normal force of the pickup arm 38 for placing the print media 34 at a position precisely when placing the print media 34 inside the paper-feeding mechanism and the disadvantage of overcoming normal force of the pickup arm 38 for clearing a paper jam.

In contrast with the conventional paper-feeding mechanism, the paper-feeding mechanism according to the present invention only utilizes a gear inside a pickup arm for transmitting power to a pickup roller so that the cost of material and mechanical assembly are decreased. In addition, the decrease in the number of internal components reduces the possibility of breakdown in addition to reducing total tolerance and transmission noise.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A paper-feeding mechanism comprising:

a paper tray for positioning a print medium;

a pickup roller installed in front of the paper tray for pressing the print medium so as to pick up the print medium;

a pickup arm fixed to a first shaft at one end and connected to the pickup roller at another end for driving the pickup roller to rotate around the first shaft;

a first gear installed inside the pickup arm and connected to a first end of the pickup roller;

a swing arm fixed to a second shaft at one end and connected to a second gear for engaging with the first gear at another end;

a third gear fixed to the second shaft and engaged with the second gear for driving the swing arm and the second gear to rotate; and a driving device for driving the third gear.

2. The paper-feeding mechanism of claim 1 wherein the driving device further comprises a fourth gear engaged with the third gear for transmitting motive power to the third gear.

3. The paper-feeding mechanism of claim 2 wherein the driving device further comprises a motor for driving the fourth gear so as to drive the third gear to rotate.

4. The paper-feeding mechanism of claim 1 further comprising a sheath around a second end of the pickup roller.

5. The paper-feeding mechanism of claim 4 wherein the sheath is made of rubber material.

6. The paper-feeding mechanism of claim 1 further comprising a burster for blocking a bottom of the print medium so as to buckle the print medium when the pickup roller picks up the print medium.

7. The paper-feeding mechanism of claim 1 wherein the print medium is paper.

* * * * *